United States Patent [19]

Carlson

[11] 4,033,090

[45] July 5, 1977

[54] MACHINE FOR PACKAGING ROLLS OF COINS

[75] Inventor: Alvin R. Carlson, Pico Rivera, Calif.

[73] Assignee: Bank of America National Trust & Savings Association, San Francisco, Calif.

[22] Filed: Sept. 22, 1976

[21] Appl. No.: 725,387

Related U.S. Application Data

[63] Continuation of Ser. No. 576,592, May 12, 1975, abandoned.

[52] U.S. Cl. ..... 53/78; 53/162; 53/245; 53/391

[51] Int. Cl.[2] ..... B65B 5/06; B65B 35/50; B65B 67/02

[58] Field of Search ..... 53/26, 78, 160, 162, 53/245, 390, 391

[56] References Cited

UNITED STATES PATENTS

| | | | |
|---|---|---|---|
| 1,555,225 | 9/1925 | McKaig | 53/162 |
| 2,743,563 | 5/1956 | Jorgensen et al. | 53/162 X |
| 2,765,599 | 10/1956 | Johnson | 53/26 |

*Primary Examiner*—Robert Louis Spruill

*Attorney, Agent, or Firm*—Flehr, Hohbach, Test, Albritton & Herbert

[57] ABSTRACT

A system for loading a predetermined plurality of rows of rolls of coins from a roll-receiving table into a box includes conveyor means for receiving each fully loaded box, means movable between raised and lowered positions for supporting the box on a side thereof with an opening of the box exposed to receive rows of rolls urged endwise into the box from the table to cause the box to move downwardly upon receipt of each row of rolls. Means limiting the downward movement of the box-supporting means after each loading of a row of rolls into the box serves to register the box opening in position to receive each subsequent row of rolls. A fulcrum means carried substantially at the predetermined level of the conveyor when the box has been filled permits the box to be tipped across the fulcrum onto the conveyor to dispose the box opening at the top of the box for transport via the conveyor to an inspection station. The limiting means serves to inhibit the downward movement of the box upon arrival of the box at a next subsequent loading position and in response to successive loadings of each of a series of predetermined numbers of rolls into the box serves to move the box in stages in response to each loading. A preferred method carries out the above steps.

7 Claims, 9 Drawing Figures

PRIOR ART
FIG_8
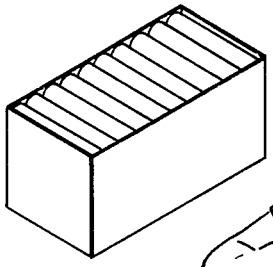
FIG_9
PRIOR ART
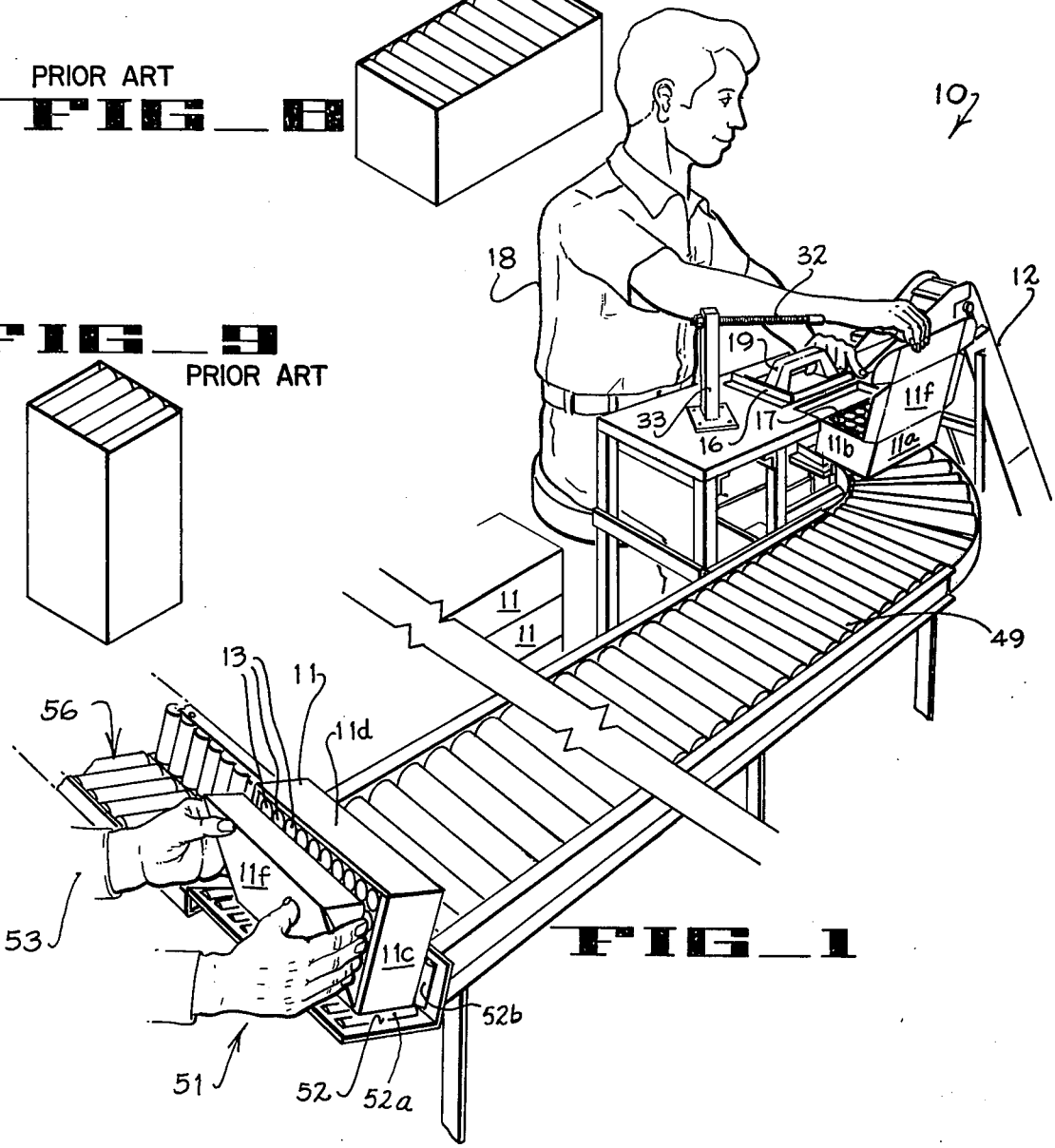
FIG_1
FIG_2
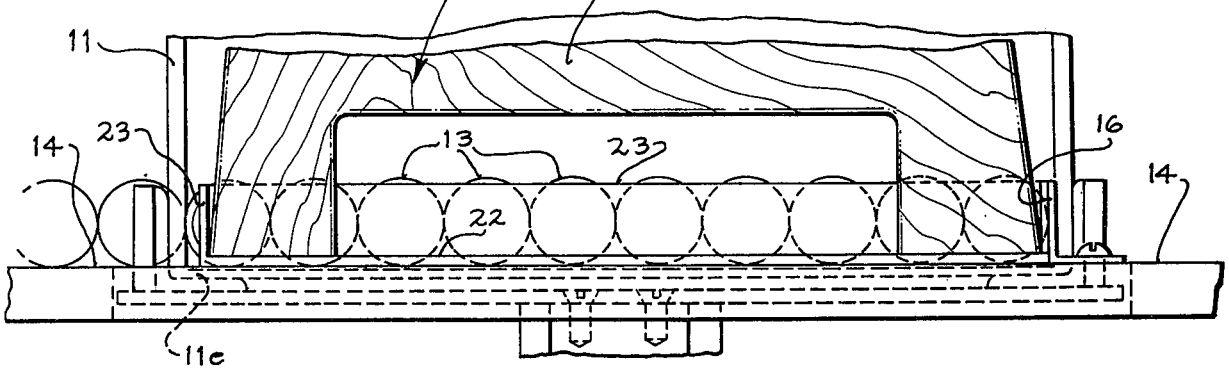

MACHINE FOR PACKAGING ROLLS OF COINS

This is a continuation of application Ser. No. 576,592, filed May 12, 1975, and now abandoned.

BACKGROUND OF THE INVENTION

This invention pertains to machines and methods of a type involved in packaging rolls of coins after they have been wrapped.

Heretofore, several types of containers hereinafter referred to solely as "boxes" though it is to be understood that the term "boxes" is deemed to include containers of various types for use as described, including four sides, a bottom and a top in which the top portion is open for filling. In packaging rolls of coins into boxes for shipment between banks, for example, and to customers of banks, the procedure for loading the boxes with rolls of coins must be such as to prevent the box from giving the appearance of having been completely filled with coins when, in fact, some rolls may be missing.

For example, as shown in FIG. 8, a box of a type presently used is shown in which only ten rolls are visible when the box is loaded. One means of verifying the contents of the box could be to unload the box and re-count the rolls. Another approach has been to weigh the box after it is filled and then compare the weight with the standard weight for a box and its complete contents since it is possible to insert other material in the box beneath the top row of rolls to cause the top row of rolls to give a false appearance that the box is full. However, with the added weighing procedure, it is still possible to supply a weight equal to the missing rolls.

A similar problem exists in a box of the type shown in FIG. 9. However, when using a box of the type shown in FIG. 1, the ends of all rolls of coins will be visible to an inspector for verification simply by opening the lid of the box.

Loading boxes of the kind shown in FIG. 1 in many instances has required manual insertion of the rolls, and this, of course, requires a substantial and expensive labor force. According to the present invention, a means involving relatively limited manual labor and limited effort or exertion on the part of the operator who loads the boxes has been shown.

SUMMARY OF THE INVENTION AND OBJECTS

In general, there has been disclosed a system for loading a predetermined plurality of rows of rolls of coins from a roll-receiving table into a box of a type having four sides, a bottom, a top opening and a lid for closing the opening. The system comprises conveyor means for transporting the boxes to be disposed at a predetermined level for receiving each loaded box. The box is supported for loading on means movable between raised and lowered positions for supporting the box on a side of the box with the opening of the box exposed to receive rows of rolls urged endwise into the box from the table. In addition to the above, means are provided which serve to limit the downward movement of the last named means after loading each row into the box until the box is filled. Fulcrum means carried substantially at the level of the conveyor when a box has been filled serves to permit the box to be tipped across the fulcrum onto the conveyor to re-orient the opening of the box to the top of the box for transport via the conveyor to an inspection station.

The foregoing system includes an improved loading station requiring no additional weighing of the box to verify its contents. Thus, the loading station includes a roll-receiving table, means for supplying rolls of coins to the table to support the rolls in substantially parallel relation in a predetermined plane. The box-supporting means is movable between raised and lowered positions to carry the box therewith relative to the aforementioned predetermined plane. The box-supporting means serves to carry the box with an opening thereof in position to receive a predetermined number of rolls forming a group thereof to be urged into the box from the table. Means for sequentially urging each of a plurality of groups of rolls into the box is provided. Means controlling movements of the support means serves to register the opening of the box in position to receive the first group of rolls to be loaded into the box. The last named means is responsive to each loading of a group of rolls into the box (with the exception of the loading of the final group of rolls) so as to register the opening of the box to a position to receive another group of rolls into the box.

Preferably, the last named means serves to permit the box to move to a position precluding further loading of the box in excess of the named plurality of groups of rolls after loading the aforementioned plurality of groups of rolls.

In general, it is an object of the present invention to provide an improved coin-packaging machine and method for packaging rolls of coins.

A further object of the invention is to provide a means and method of packaging rolls of coins in a manner whereby verification is readily and accurately achieved.

Yet another object of the invention is to provide a method and means of packaging rolls of coins with limited physical exertion.

The foregoing and other objects of the invention will become more readily evident from the following detailed description of a preferred embodiment as shown in the accompanying drawings.

BRIEF DESCRIPTION OF THE DRAWINGS

FIG. 1 shows a perspective overall view of a system according to the invention;

FIG. 2 shows an elevation view of a detail taken along the line 2—2 of FIG. 3;

FIGS. 8 and 9 each show prior art coin boxes.

DETAILED DESCRIPTION OF THE PREFERRED EMBODIMENT

Figures 3, 4:
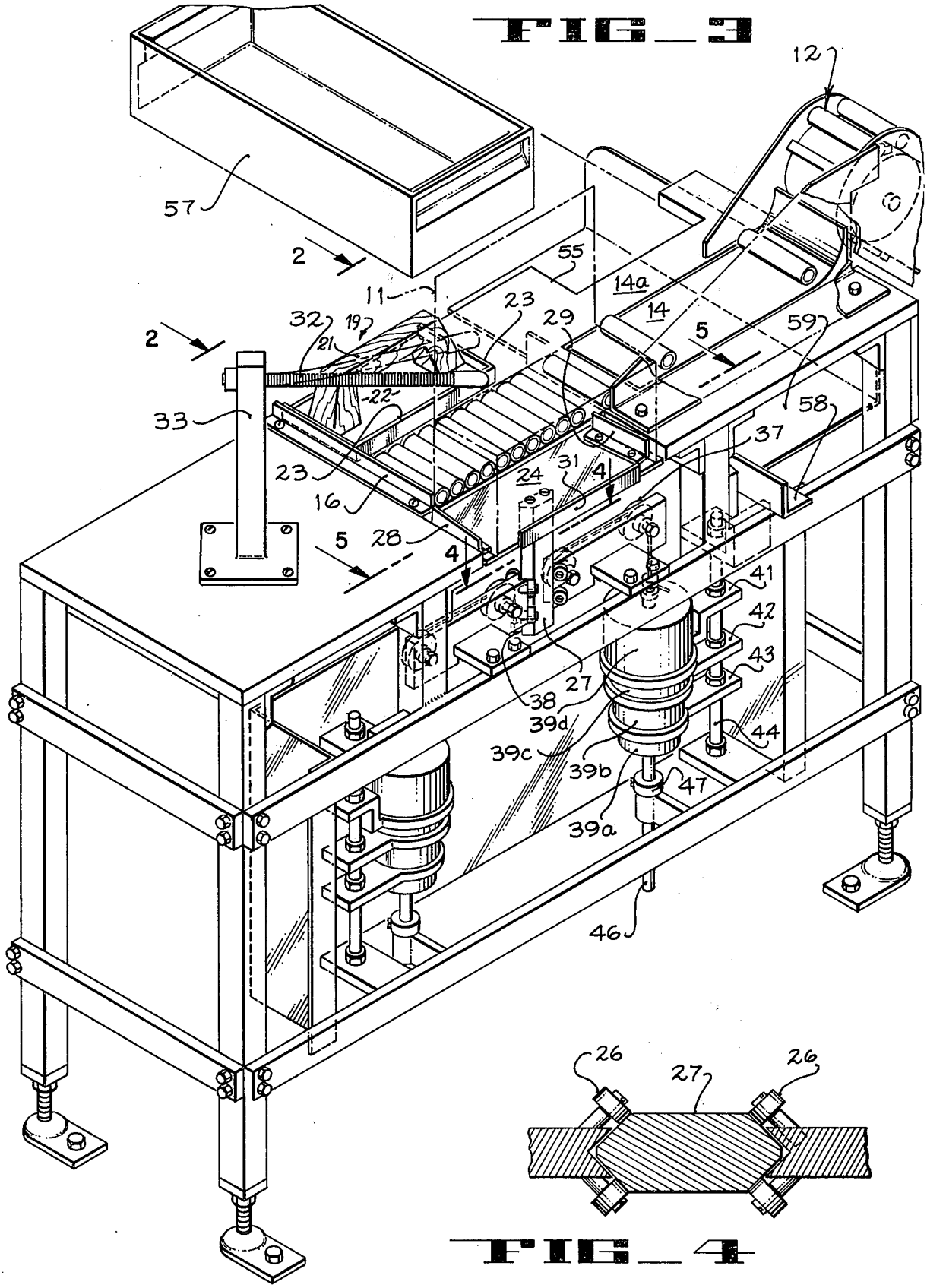
FIG. 3 shows a perspective view, partially exploded, for a loading station according to the invention.
FIG. 4 shows a plan view in section of a detail taken along the line 4—4 of FIG. 3.

A system for loading a predetermined plurality of rows of rolls of coins into containers such as boxes 11 is shown in FIG. 1. Accordingly, an elevator-type conveyor 12 serves to carry pre-wrapped rolls 13 of coins upwardly for discharge onto a roll-receiving table 14 where the rolls are aligned in substantially parallel relation in a common plane for loading into boxes 11.

Table 14 is tipped at a very slight angle so that as rolls 13 are deposited onto table 14, they will tend to roll to the operator's right hand side as shown. Alignment of the rolls is achieved simply by moving the rolls to the operator's right into parallel engagement with an elongated rib 16 fastened to the top of table 14.

Box 11 includes a number of panels including four sides 11*a*, 11*b*, 11*c*, 11*d* and a bottom portion 11*e*. Box 11 includes a top opening 17 adapted to be closed by folding over a lid or top closure panel 11*f* and tucking the sides and forward margin thereof downwardly alongside panels 11*b*, 11*c*, 11*d*.

A loading station includes means as now to be described for supporting the boxes 11 in position movable between raised and lowered positions in registration with the plane of table 14. The supporting means serves to carry the box with its opening 17 in position to receive groups of rolls urged into the box from the table. In addition, means controlling movement of the support means serve to register opening 17 of the box in position to receive the first of a plurality of groups of rolls to be loaded into the box. The controlling means referred to above is responsive to each but the final loading of each group of that plurality of rolls to be loaded into the box so as to register the opening of the box at a position relative to the plane of table 14 to receive each subsequent group of rolls into the box.

Figure 5:
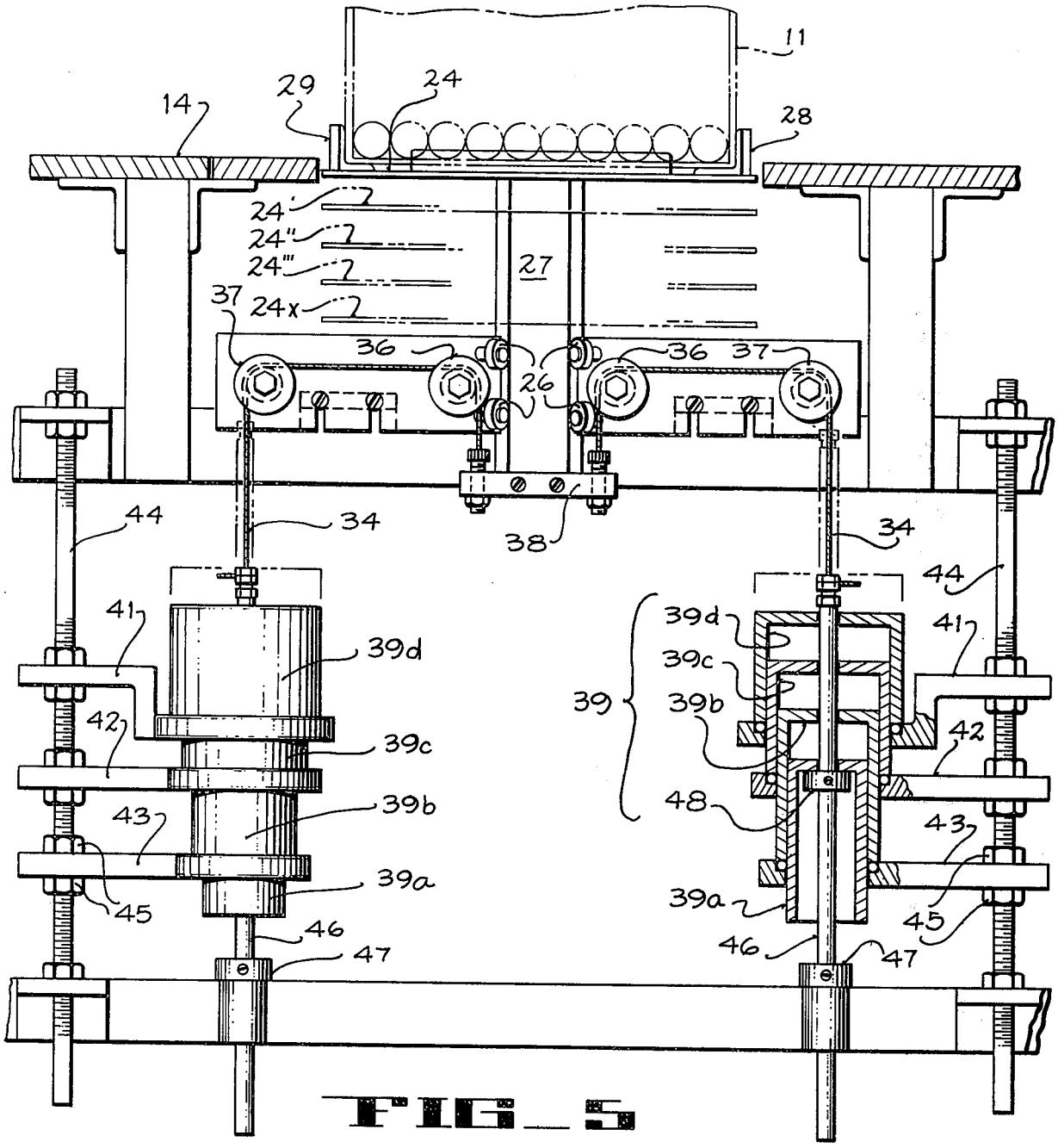
FIG. 5 shows an elevation view, partly in section, of a coin roll packaging station according to the invention.

In general, the operator 18 positions each box 11 initially in the position shown in phantom lines in FIGS. 3 and 5 so that the top opening of the box faces operator 18. Then, after having aligned the rolls 13 parallel to rib 16, the trowel-like pusher 19 is used in order to urge a group of rolls endwise into box 11 so as to form a row of rolls of coins in the box.

The pusher device 19, as best seen in FIG. 2 is of a relatively simple construction including a handle 21 secured to a flat bottom plate 22 formed with an upwardly extending edge margin 23 around three sides of plates 22. The lateral extent of pusher 19 is slightly less than the sum of the diameters of that number of rolls 13 sufficient to substantially extend from one end of box 11 to the other. Accordingly, the lateral extent of pusher 19 leaves some limited clearance for moving the rolls into each box 11.

Operator 18 positions boxes 11 in sequence (to the position shown in phantom lines in FIGS. 3 and 5) upon a support platform 24 mounted to move between raised and lowered positions guided by the bearings 26 (FIG. 4) acting upon the beveled sides of a support post 27 engaged therebetween.

The top surface of platform 24 is arranged with end flanges 28, 29 which serve to position the box upon platform 24. That edge of platform 24 remote from operator 18 carries an upwardly extending rigid fulcrum element 31 for purposes as will be described further below.

In addition to the purposes described further below, however, fulcrum element 31 also serves to maintain the box stationary upon platform 24 during the urging of rolls 13 into the box.

As a convenience to the operator in handling the coins when loadng the box, the lid 11*f* is retained in an upward position so as to maintain the box opening 17 unobstructed by means of the resilient retaining arm 32 carried to extend laterally from the top of a support post 33 mounted upon the top of table 14.

In general, as each predetermined number of rolls of coins is loaded into box 11, the box is arranged to move to a lower position to become registered in position to receive the next layer or row of rolls. Accordingly, the weight of the rolls being loaded serves to cause the platform 24 to move downwardly until inhibited or limited by apparatus as now to be described.

Figure 6:
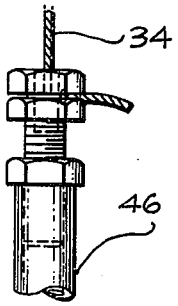
FIG. 6 shows an enlarged detail view of a portion of FIG. 5.

Support post 27 is carried to its upward position as shown in FIG. 5 by means of a pair of cables 34 each of which is trained about a pair of pulleys 36, 37. Each cable is coupled at its upper end to a transversely extending bracket 38 carried by post 27. The other ends of cables 34 are coupled in the manner shown in FIG. 6 to carry one or more of a plurality of nested weights 39 disposed in adjustable aligned positions by their respective support brackets 41, 42 and 43. The transversely extending support brackets 41, 42 and 43 are adjustably clamped by nuts 45 to fixed positions along a support rod 44 extending between portions of the frame so as to control and adjust the position of platform 24 relative to table 14 in response to loading of each row of rolls into box 11.

An end of each cable 34 is coupled to an associated one of the two rods 46 journalled in a bearing 47 for moving between advanced and retracted positions.

As shown in FIG. 5, rod 46 is at its lowest position in view of the fact that platform 24 has been raised substantially to the predetermined plane of table 14 so as to permit rolls 13 to be pushed into box 11 to form the first row of rolls in box 11.

As shown in FIG. 5, however, box 11 is completely unloaded and rolls 13 are merely shown in phantom lines to show the location where they will be upon being urged into the box.

After the first group of rolls is urged into box 11, the collar 48 fastened to rod 46 carries one of the cup-like weights 39*a* upwardly with it until the top of cup 39*a* strikes the undersurface of cup 39*b*. Upon engagement with weight 39*b*, further movement downwardly of platform 24 will be inhibited or limited to the extent that the weight of the one row of coins now loaded will not be sufficient to overcome the combined weight of weights 39*a* and 39*b*.

However, at this position, platform 24 will have been moved to the position shown at 24′ and thereby dispose the first row of coins in a position immediately below the plane of table 14 to be in position to receive another group of coins urged into box 11 by means of pusher 19.

When the second row of coins is urged into box 11 by pusher 19, platform 24 will again drop to another position limited by the inhibiting force of the aggregate weight of weights 39*a*, 39*b* and 39*c* when the top of weight 39*b* engages weight 39*c*. At that point platform 24 will have arrived at position 24″ and the top of the second row of coins will be immediately beneath the level of the plane of table 14 for receiving a third row of coins to be urged into the box.

Upon urging the third row of coins into box 11, the aggregate weight of cups 39*a*, 39*b* and 39*c* will no longer be sufficient to restrain platform 24 from moving downwardly and, accordingly, all three cups will move upwardly until engaging and acquiring the resistance of the weight of weight 39*d* so as to dispose platform 24 at a location identified as 24‴. Subsequently, another predetermined group of coins is loaded into box 11 and platform 24 again sinks to a position, for example, identified as 24*x*.

Upon movement of box 11 on platform 24 downwardly to the position 24*x* the top edge of box 11 becomes located at a positive above but sufficiently close to the plane of table 14 that further loading of coins into that box will be precluded by the existence of the transversely extending side wall 11*a*.

In the foregoing manner, a box will have been loaded completely while lying on its side and will have moved downwardly substantially to the level of a conveyor 49. Under such circumstances, the box can readily be tipped across fulcrum element 31 so as to orient the ends of the rolls 13 to extend upwardly toward the open top of the box.

An inspection station 51 includes a receiving trough 52 disposed transversely of the direction of movement of box 11 on conveyor 49. The V-shaped trough 52 is defined by two sets of rollers 52*a*, 52*b* aligned with conveyor 56 for supporting the side and bottom of box 11 respectively and located below and beyond the end of conveyor 49 to permit box 11 to fall into trough 52 without being required to be tipped by the operator and to dispose the opening of the box in a confronting position to an inspector 53 stationed at station 51. The inspector can thus readily verify the presence of the rolls in box 11.

Subsequently, box 11 can be closed by inspector 53 and then discharged laterally along a conveyor 56.

From the foregoing, it will be readily evident that there has been provided a relatively easy method for packaging rolls of coins on their ends into boxes in a manner substantially automatically permitting verification of the loading procedure and of the number of rolls loaded into each box.

Figure 7:
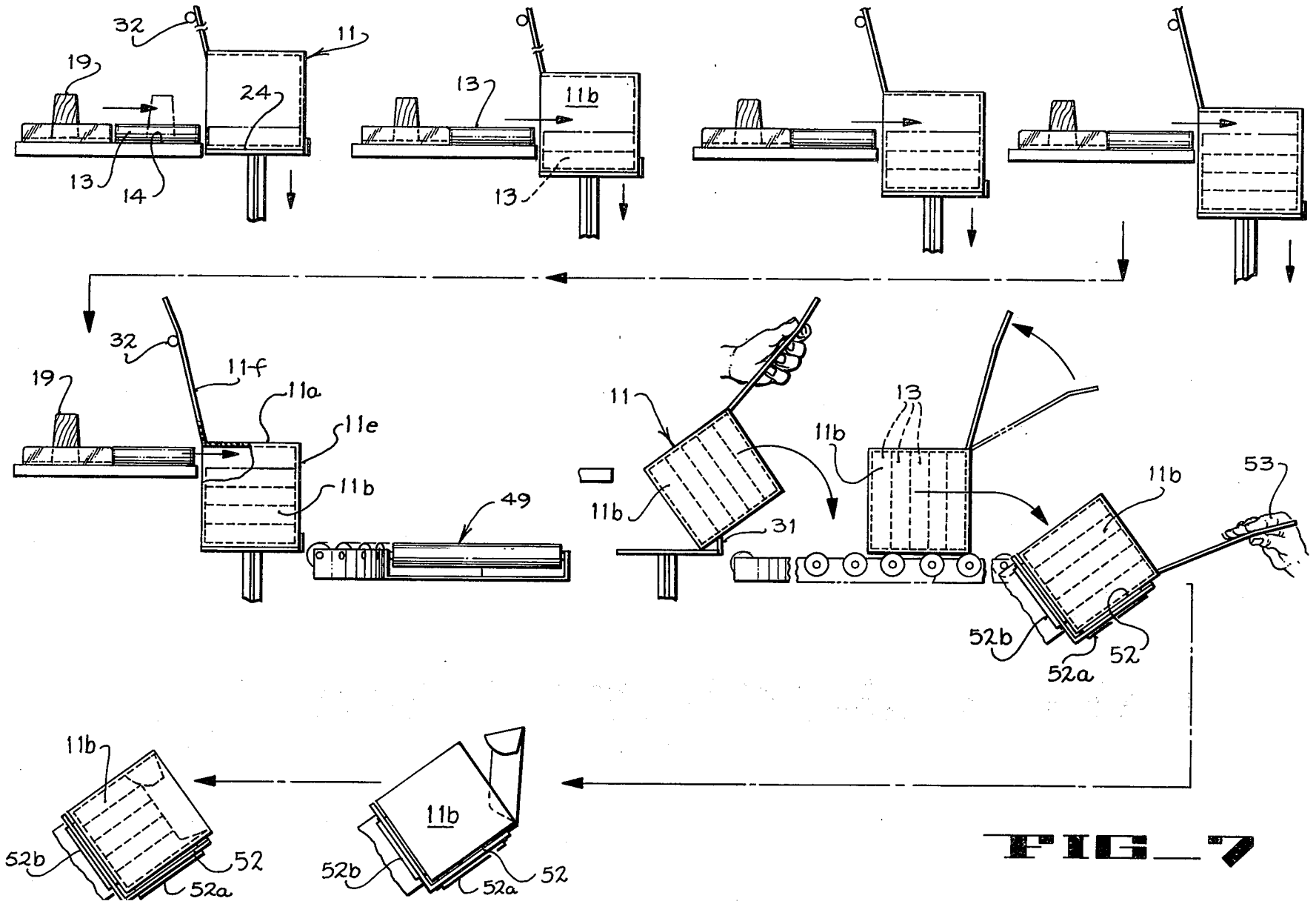
FIG. 7 shows a flow diagram representing the loading of pre-wrapped coins into a box and packaging them into the box.

Accordingly, as shown in FIG. 7, the method of packaging rolls of coins into a box of the type having four sides, a bottom, a top opening and a lid for closing the top opening includes the steps comprising arranging the rolls of coins in substantially parallel relation on a roll-receiving table 14, disposing a box 11 onto a support 24 adjacent table 14 for movement between raised and lowered positions, orienting the box on the support 24 on its side with the top opening confronting the ends of rolls on the table, pushing that number of rolls endwise simultaneously into the box as will form a complete row of rolls in the box, lowering the box in response to receipt of the row of rolls therein, inhibiting the downward movement of the platform upon disposing the platform in registration with table 14 to receive another row of rolls into box 11, repeating the last three named steps above until the box is filled, and then tipping the box so as to rest on its bottom surface.

The method further contemplates additional steps such as conveying the box to an inspection station, tipping the box further in the same direction as before to rest on both a side and on the bottom for inspection of the contents of the box, closing the lid of the box to retain the rolls of coins therein, and conveying the box endwise from the inspection station.

Occasionally, as rolls 13 are delivered onto table 14 there will be a broken wrapper or even loose coins. In either circumstance, these defective rolls are swept over onto table portion 14*a* and into a drawer 57 located to receive the coins via opening 55 cut into portion 14*a*. Drawer 57 moves into and out of position as it is being supported on leaf 59 carried at its distal end by the angle iron support 58.

From the foregoing, it should be readily evident that there has been provided an improved system and method of packaging pre-wrapped rolls of coins into boxes for purposes of verifying the loading activity with a relatively simple physical motion on the part of an operator.

I claim:

1. A machine for packaging a predetermined number of rolls of coins, in successive overlying rows upon each other, endwise in a box relative to an open top thereof, comprising; a loading station at which a machine operator is located; an elongated inclined table at said station; conveyor means for supplying rolls of coins onto said table in side-by-side contacting relationship thereon, the incline of said table causing said rolls of coins supplied thereto to move toward one end of said table under the effects of gravity; means at said station adjacent said table for movably supporting a box to be filled on its side in predetermined orientation with an open top thereof facing said table and with one side panel thereof initially generally aligned with the top of said table; said box supporting means comprising an incrementally downwardly movable platform upon which said box side panel rests, pulley and connector mechanism including at least one elongated flexible connector operatively engaged with said platform at one end of each such connector, and counter weight structure operatively connected with the other end of each such connector; said counter weight structure including a series of vertically spaced interfitted weight members the lowermost of which is engaged with said other end of its associated connector, each of said weight members corresponding generally in weight with the collective weight of a single row of rolls of coins to be inserted endwise into said box, support structure mounting said weight members independently of each other and in vertically spaced relationship for movement relative to each other so that successive weight members may be brought into contact with and move each other upwardly upon downward movement of said platform and said connector therewith; operator actuated pusher means movable transversely and sequentially across said table relative to said box in response to operator actuation to sequentially contact the ends of a predetermined number of rolls of coins and urge the same endwise into said box as discrete successive rows; said counter weight structure reacting in response to incremental movement of said platform downwardly in response to the combined weight of each successive row of rolls of coins inserted in sequence into said box in response to sequential actuation of said pusher means, so that each successive underlying weight member is moved upwardly into sequential contact with a successive overlying weight member, whereby the combined weight supported on said connector is progressively increased as successive rows of rolls of coins are inserted into said box, downward movement of said platform being positively halted in predetermined increments following insertion of each successive rows of rolls of coins into said box by each successive underlying weight member contacting its adjacent successive overlying weight member.

2. The coin packaging machine of claim 1 in which the respective weight members of said counter weight structure are in the form of hollow cylinders of progressively larger diameter, each underlying cylinder being received at least partially within its adjacent overlying cylinder for upward movement therein in response to downward movement of said platform.

3. The coin packaging machine of claim 1 in which the number of weight members in said counter weight structure is one less than the number of rows of rolls of coins to be inserted into said box.

4. The coin packaging machine of claim 1 which includes means positioned above said table for maintaining the lid of said box out of the way of the open top of said box during loading thereof.

5. The coin packaging machine of claim 1 which further includes a conveyor adjacent said loading station onto which filled boxes may be placed by said machine operator for movement from said loading station.

6. The coin packaging machine of claim 5 which further includes a rigid fulcrum element along an edge of said platform adjacent said conveyor to cause a filled box to tip onto its bottom on said conveyor in response to urging by said machine operator.

7. The coin packaging machine of claim 5 which further includes an inspection and box closing station at the other end of said conveyor at which filled boxes are to have their lids closed after visual inspection of the ends of the rolls of coins in each such box has confirmed the correct number of rolls of coins has been inserted therein.

* * * * *